United States Patent [19]

Neidecker et al.

[11] Patent Number: 4,990,098

[45] Date of Patent: Feb. 5, 1991

[54] CURRENT BAR ARRANGEMENT

[75] Inventors: Rudolf Neidecker, Basel; Jacques Kunz, Schonenbuch, both of Switzerland

[73] Assignee: Multi-Contact AG, Switzerland

[21] Appl. No.: 434,880

[22] Filed: Nov. 9, 1989

[30] Foreign Application Priority Data

Nov. 15, 1988 [CH] Switzerland ..... 4225/88-6

[51] Int. Cl.[5] ..... H01R 4/60

[52] U.S. Cl. ..... 439/207; 174/70 C; 174/117 F

[58] Field of Search ..... 439/207, 209, 118; 174/70 C, 72 C, 117 F

[56] References Cited

U.S. PATENT DOCUMENTS

| | | | |
|---|---|---|---|
| 2,170,299 | 8/1939 | Frank | 439/118 |
| 2,274,136 | 2/1942 | Frank et al. | 439/118 |
| 3,029,303 | 4/1962 | Severino | 439/209 X |
| 4,003,618 | 1/1977 | Booty . | |

FOREIGN PATENT DOCUMENTS

| | | | |
|---|---|---|---|
| 0051951 | 5/1982 | European Pat. Off. . | |
| 513840 | 11/1920 | France | 174/117 F |
| 1169096 | 9/1958 | France | 174/70 C |
| 927524 | 5/1963 | United Kingdom | 174/117 F |

*Primary Examiner*—Eugene F. Desmond

*Attorney, Agent, or Firm*—Tarolli, Sundheim & Covell

[57] ABSTRACT

A current bar arrangement includes a flat, two-wire, flexible cable (2) provided with a rubber-like insulation (2.3). The cable has a plurality of holes (2.4) stamped in the insulation at a mutual distance between the two wires (2.1, 2.2). The two wires are laid bare in each case for a short distance. The current bar arrangement also has a cable channel (1) substantially form-stable in the lengthwise direction and substantially U-shaped in profile for receiving and holding the cable. The current bar arrangement is very versatile and variable in use, but especially in low-voltage halogen lighting systems. It is distinguished by an especially simple technical construction and, associated with this, by a very low production cost.

9 Claims, 5 Drawing Sheets

CURRENT BAR ARRANGEMENT

TECHNICAL FIELD

The present invention relates to a current bar arrangement, especially for low-voltage halogen lighting systems.

BACKGROUND ART

Most of the halogen lighting systems known today are constructed on the basis of current bars. Current bars offer the advantage that lamps can be connected to them in practically any variable position. Besides the supplying of current, current bars usually serve also for the mechanical holding of the lamps connected to them. Current bars usually consist of form-stable tubes or hollow profiles with lengthwise slits for receiving two or even three usually bare conductors. The conductors are insulated from each other, and with the use of a conductive material for the sheathing tube or hollow profile, from the latter also. As a rule, specially adapted connecting parts are provided in each case for the feeding of voltage to the current bars, the connecting of the lamps, and the connecting together of several current bars or parts thereof. These must assure a secure contacting and, like the current bar itself, must have sufficiently high mechanical stability and load capacity.

The meeting of all these requirements means, in most of the halogen lighting systems known today, a relatively high technical outlay and thus a relatively high production expense.

SUMMARY OF THE INVENTION

The problem of the present invention is to provide a current bar arrangement meeting all the requirements mentioned above, technically simple in design, easy to handle, versatile in its use and, above all, very economical to produce.

This problem is solved, according to the present invention, by a current bar arrangement with the features of claim 1.

Preferred embodiments of the present invention are distinguished in the dependent claims.

BRIEF DESCRIPTION OF THE DRAWINGS

The present invention will be explained in detail below with reference to the attached drawings.

In the figures, equal or functionally equal parts are given corresponding reference numbers.

DESCRIPTION OF SPECIFIC EMBODIMENTS OF THE INVENTION

Figure 1:
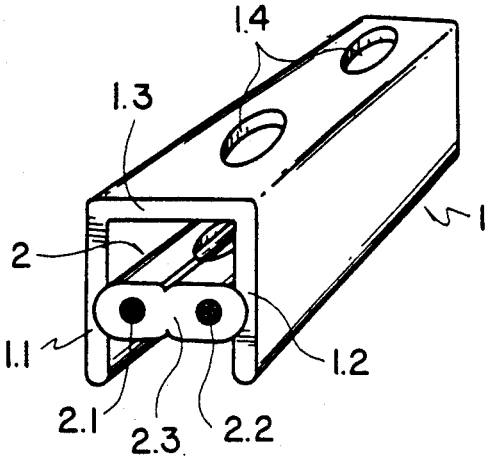
FIG. 1 shows in perspective view a current bar arrangement constructed in accordance with the present invention, with a two-strand flat perforated cable laid into a cable channel.
Figure 2:
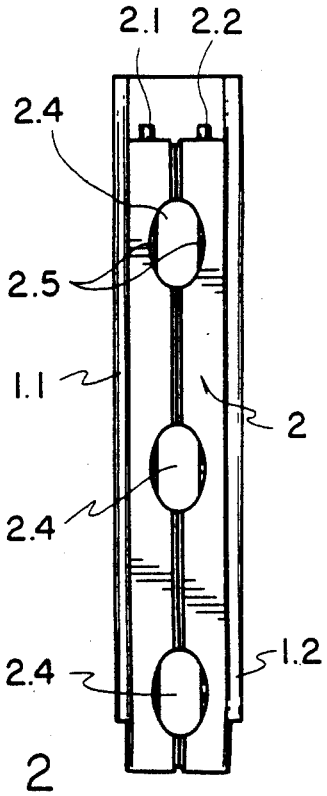
FIG. 2 shows in bottom view the current bar arrangement of FIG. 1.
Figure 3:
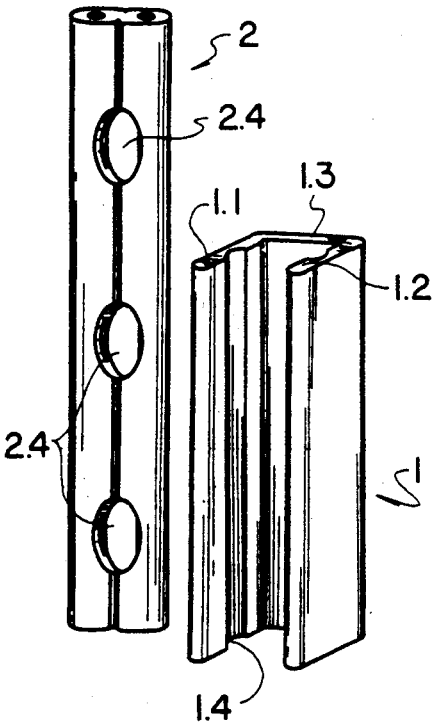
FIG. 3 shows separated and in perspective view the perforated cable and the cable channel of FIG. 1.

Referring to FIGS. 1 to 3, a current bar arrangement constructed according to the present invention includes a cable channel 1 with a perforated cable 2 laid therein.

The cable channel 1 has a uniform, substantially U-shaped profile in its lengthwise direction, and thus has two leg strips 1.1, 1.2, as well as a base strip 1.3. It is preferably made of plastic material and produced in an extrusion process.

The perforated cable is a flat, two-wire cable. Its two strands 2.1 and 2.2 are enclosed by a rubber-elastic insulation 2.3, and preferably consist of tinned copper wires with a cross-sectional area of 1 square millimeter. Holes 2.4 between the two strands are stamped into the insulation 2.3 at regular intervals of, preferably, 2 centimeters for example. The holes 2.4 are longer in the lengthwise direction of the perforated cable 2 than transverse to same, and thus are about oval in shape. This lays bare a short section of the two wires in each case. Two such sections laid bare are indicated in FIG. 2 by reference numeral 2.5.

The cable channel 1, as can be seen especially in FIG. 3, is provided with an inner contour on the inner side of its two leg strips 1.1 and 1.2. The inner contour is adapted to the outer contour of the perforated cable 2 in order to hold the latter between the two leg strips 1.1 and 1.2, as shown in FIG. 1. The perforated cable is so held in the cable channel by its two flat sides and is directed parallel to the base strip 1.3 of the cable channel.

The inner contour may be formed, as shown, by grooves 1.4 in the leg strips 1.1, 1.2 and/or by stays on the latter.

The two leg strips 1.1, 1.2 of the cable channel 1 are naturally somewhat resilient. The inner contour of the cable channel as well as the spring characteristic of its leg strips are designed and adapted to each other over the whole length of the perforated cable 2. The perforated cable can be pressed by hand from outside into the cable channel 1 with the springing apart of its leg strips 1.1, 1.2, and held in the cable channel 1 with the springing back of the leg strips.

For optical reasons in particular, a covering for the cable channel may also be provided Naturally, this may also be designed and fastened to the cable channel so that it additionally secures the perforated cable in the cable channel to prevent a sliding out.

Figure 4:
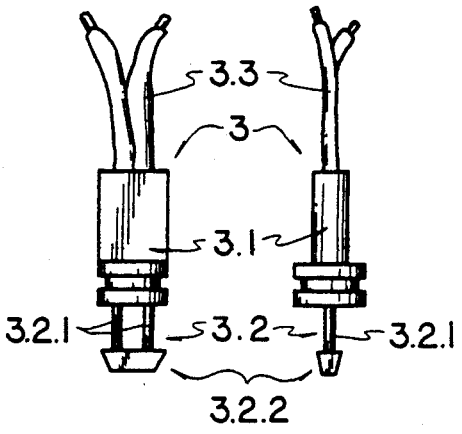
FIG. 4 shows in two side views rotated by 90° from each other a two-pole plug suitable for plugging into the holes of the perforated cable.

If there is one voltage between the two wires of the perforated cable 2, preferably a plug of the kind shown in FIG. 4 is used as a connecting element to the current bar arrangement according to the invention. The plug 3, represented in FIG. 4 in two views rotated from each other by 90°, has a handle part 3.1 of an insulating material, and a plug-in and contact part 3.2. Two contact pins 3.2.1 insulated from each other at a mutual distance and parallel with each other are arranged in the plug-in and contact part. Their length corresponds approximately to the thickness of the perforated cable 2. At the region of the plug tip, plug-in and contact part 3.2 has a thickening of an insulating material projecting beyond the contact pins. In cross section, the plug-in and contact part of the plug 3 is about oval-shaped and is substantially adapted to the shape of the holes 2.4 in the perforated cable 2. The cross-section of the thickening 3.2.2 is somewhat greater than the cross-section of the holes. The two contact pins 3.2.1 are connected, finally, with the wires of a two-wire connection cable 3.3.

Figure 5:
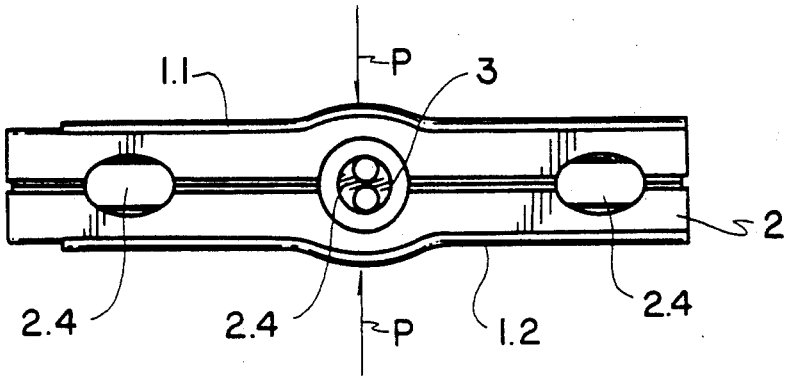
FIG. 5 is a representation according to FIG. 2, but with a plug of the kind in FIG. 4 plugged into the holes of the perforated cable, cut in the plane of the drawing.

To produce a joining connection to the current bar according to the invention, the plug 3 by its plug-in and contact part 3.2 is plugged lengthwise into one of the holes 2.4 of the perforated cable 2 previously laid into the cable channel 1, and then rotated by 90° into the position shown in FIG. 5. In this position, the two contact pins 3.2.1 are in contact with the sections 2.5 laid bare by the holes 2.4 on the two wires 2.1, 2.2 of the perforated cable.

By the design of the thickening 3.2.2 which is somewhat greater in cross-section at its tip than the cross-section of the holes 2.4, the plug 3 can only be plugged into the holes 3 with a certain elastic deformation of the perforated cable 2, especially of its insulation 2.3. This results in a small widening of the perforated cable at the insertion point in plugging in the plug. The two leg strips 1.1 and 1.2 of the cable channel 1 correspondingly spring outward somewhat. Completely plugged in, the plug 3 is held upright in the perforated cable 2. In this way, even in the position not yet rotated by 90° in which the two contact pins 3.2.1 of the plug 3 still do not contact the two wires 2.1 and 2.2 of the perforated cable 2, a very good mechanical holding of the plug is reached in the perforated cable or in the current bar arrangement generally. In the contact position shown in FIG. 5, the mechanical anchoring of the plug 3 is much better still, since in this position the perforated cable is widened still more in the plug region. The counter-pressure exerted by the leg strips 1.1 and 1.2 of the cable channel 1 on the contact points (arrow P in FIG. 5) also effects a favorable providing of contact.

So that the thickened tip of the plug 3 can strike through the perforated cable, the latter is arranged at a sufficient distance from the base strip 1.3, as also shown in FIG. 1.

If this distance is about equal to the thickness of the perforated cable itself, then it is possible in principle to lay a second perforated cable of the same kind into the cable channel or, for example, to let the ends of two perforated cables overlap each other to their contacting in the cable channel.

In practice, the cable channel profiles may be cut and laid in any desired length. The laying may take place in a great many ways and be adapted to each purpose of use. The laying may take place by screwing on, gluing on, hanging on, fixing by means of suction cups and the like. To permit screwing on, holes 1.4 may be provided in the base strip 1.3 of the cable channel 2, preferably at regular intervals. The distance between the perforated cable 2 and the base strip 1.3 of the cable channel is also necessary for the place needed by the screw heads in this case. The holes 1.4 in the base strip 1.3 are advantageously arranged at the same distance apart as the holes in the perforated cable 2. For gluing on, the base strip 1.3 of the cable channel 1 may be provided on the outside with an adhesive layer of glue (not shown), preferably covered by a protective foil what can be rubbed off. At least in the case of screwing on, the perforated cable is pressed into the cable channel after the laying of the latter.

The current bar arrangement described is suitable for two-pole use, especially in the construction of low-voltage halogen lighting systems. With the plug 3 described above, lamps can be connected directly to the current bar arrangement constructed in accordance with the present invention. As described above, after plugging into one of the holes of the perforated cable, the plug 3 is already sufficiently fixed mechanically, even when it has not yet been rotated into its contact position Thus, the current bar arrangement together with plugs such as the plug 3 offers the advantage that the lamps connected to it and lines can be switched on and off at any time without mechanical separation of same and without any special switches.

With a connection cable provided on both sides with a plug 3, two current bars can be electrically connected with each other in a simple way. Thus, not only extensions in particular, but practically any branching can be produced. Also, use may be made of the advantage described above for producing or breaking connections of the lamps by simply rotating one of the two plugs without loosening the connection cable mechanically.

Figure 6:
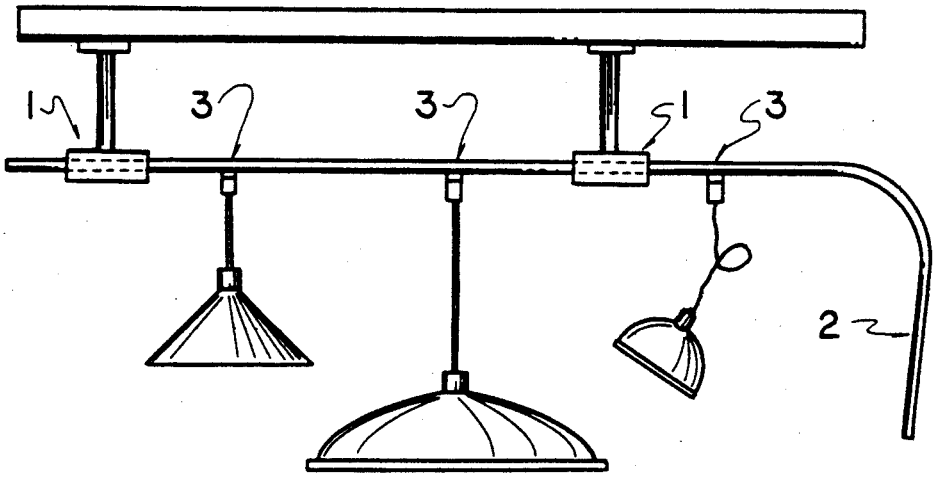
FIG. 6 shows several hanging lamps fastened and contacted on a perforated cable guided only in sections in short pieces of a cable channel.

On the other hand, it is possible to conduct a single perforated cable through several cable channels which may be arranged spatially in any desired way relative to each other. In this case, the complicated and expensive connection pieces often needed with other systems is advantageously eliminated. Also, the problems usually occurring at connection points, as well as the higher transition resistances usually present there are advantageously eliminated. In this case, the full conductor cross-section is carried through without interruption. FIG. 6 shows an arrangement in which three lamps are hung on a perforated cable 2 of the kind described above, each with a plug 3 also of the kind described. The perforated cable itself is held only in two relatively short cable channel sections 1, but otherwise is hanging free.

Figure 7:
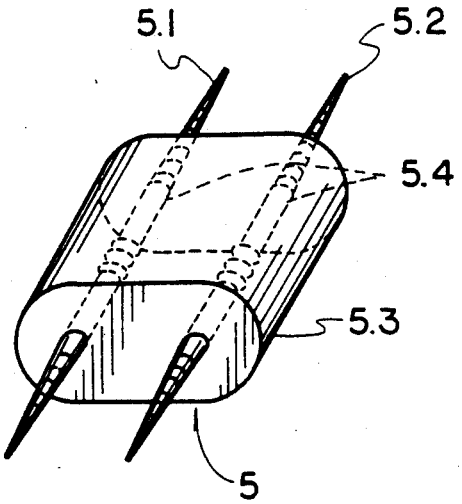
FIG. 7 shows in perspective view a first embodiment of a simple connection piece.
Figure 8:
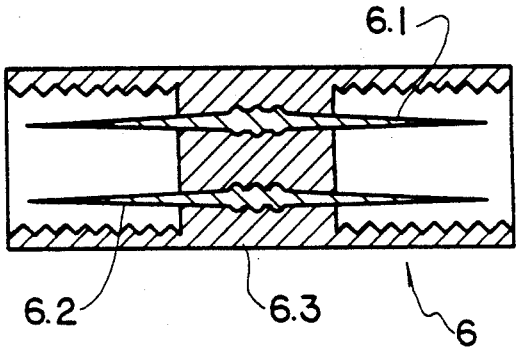
FIG. 8 shows in section view a second embodiment of a simple connection piece.
Figure 9:
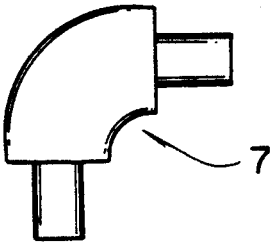
FIG. 9 shows in top view an angular connection piece.

Within the current bar arrangement constructed according to the invention, however, connection pieces of technically simple design may also be realized FIGS. 7 to 9 show examples of such connection pieces.

The connection piece 5, shown in FIG. 7, consists of two contact pins 5.1 and 5.2 running to a point on both sides. The two contact pins 5.1 and 5.2 are imbedded parallel to each other in a part 5.3 of an insulating material. The mutual distance of the two contact pins 5.1 and 5.2 corresponds exactly to the mutual distance of the two wires of the perforated cable. The outer shape of the insulating part 5.3 is also somewhat adapted to the outer shape of the perforated cable. For the connection of two perforated cables with each other, the ends to be connected with each other are placed on both sides abutting the connection piece. The result is that the tips of the contact pins 5.1 and 5.2, projecting beyond the insulating part 5.3 penetrate into the strand-form wires of the perforated cable. The tips are preferably also provided with small ridges in order to secure them against slipping out of the wires of the perforated cable. The two contact pins may also be secured by other ridges 5.4 within the insulating part 5.3 to prevent slipping out of the latter. Since the connection piece described corresponds in its outer shape to that of the perforated cable, it can be pressed together with the plugged perforated cable into a cable channel through which the whole connection is provided an excellent stabilization. The connection piece 5 serves, therefore, mainly for the connection of two perforated cables within a cable channel The perforated cable is preferably led uninterrupted over the impact point of two cable channels.

FIG. 8 shows, in section, a similar connection piece 6 in which the insulating part 6.3 projects in collar form beyond the ends. The insulating part 6.3 runs to a tip of the two contact pins 6.1 and 6.2, and is so designed there that it grips fully around the perforated cable ends as described for the connection piece 5, onto the contact pins 6.1 and 6.2. The present connection piece is particularly suitable for joining the ends of a perforation cable outside a cable channel since the ends of the perforated channel are held mechanically also. The connection piece may also be adapted on the outside to the shape of the cable channel.

FIG. 9 shows, purely schematically at right angles, a connection piece 7 of the kind shown in FIG. 7. But this could equally well correspond to the connection piece of FIG. 8 and could be adapted outside to the shape of the cable channel.

Figure 10:
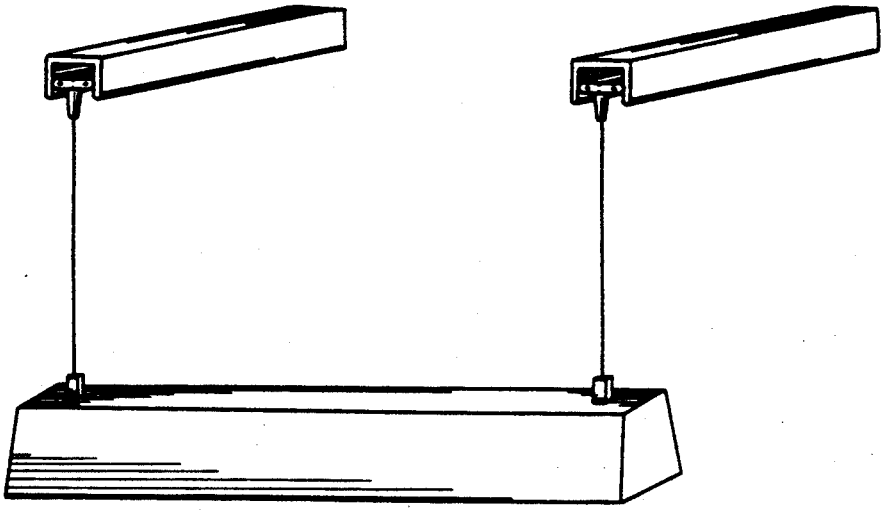
FIG. 10 shows a lamp hanging, fastened and contacted on two current bar arrangements according to the invention.

FIG. 10 shows a lamp hung on two current bars constructed according to the invention, but the two current bars are used with only one pole each. Therefore, there is no voltage here between the wires of each of the perforated cables, but only between the right and left current bar arrangement. The wires of the perforated cable are in each case connected parallel. In this way, the current bar arrangements can be used directly for high voltages also, such as 220 V for example There is provided, for instance, a doubled conductor cross-section for carrying current. For connection, the plug 3 explained from FIG. 4 may be used again, provided their two contact pins are short-circuited with each other.

Figure 11:
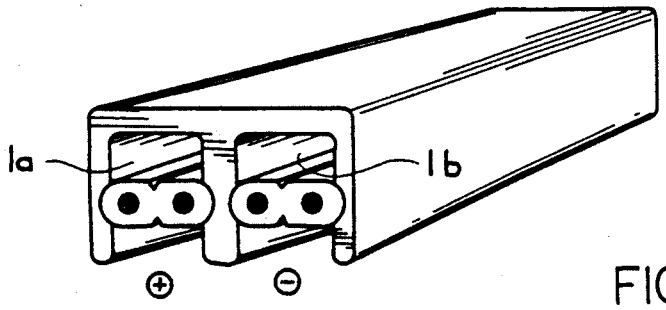
FIG. 11 is a representation according to FIG. 1, but with two cable channels side by side, each containing a perforated cable.
Figure 15:
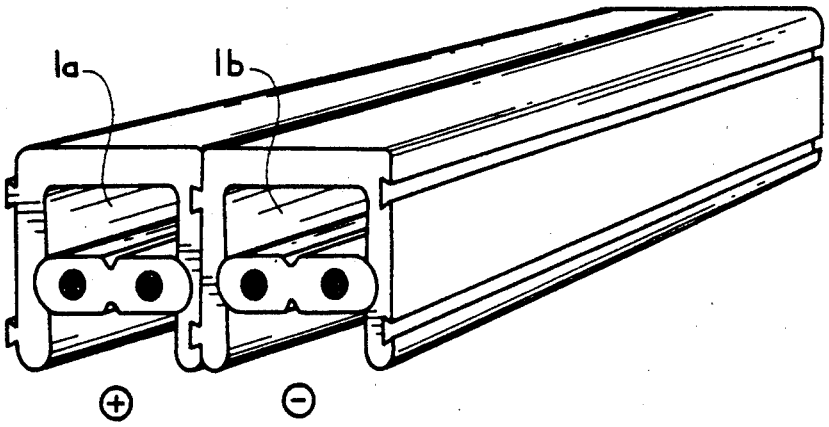
FIG. 15 shows an arrangement of current bars mountable side by side.

FIG. 11 shows a current bar arrangement specially designed for one-pole use. The current bar arrangement has two parallel cable channels 1*a*, 1*b*, each containing a perforated cable 2. The two cable channels 1*a*, 1*b* are formed in a single profile part. This current bar arrangement is also suitable for higher voltages, such as 220 V for example. Naturally, it would also be possible to design cable channels of the kind shown in FIG. 1 connectable with each other. This is possible by providing grooves or spring strips, as shown in FIG. 15, on the outside along their leg strips.

Figure 12:
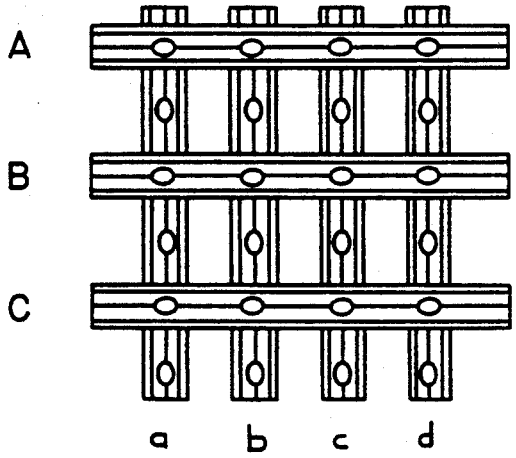
FIG. 12 shows in top view a cross bar distributor obtained by several current bar arrangements constructed according to the invention.
Figure 14:
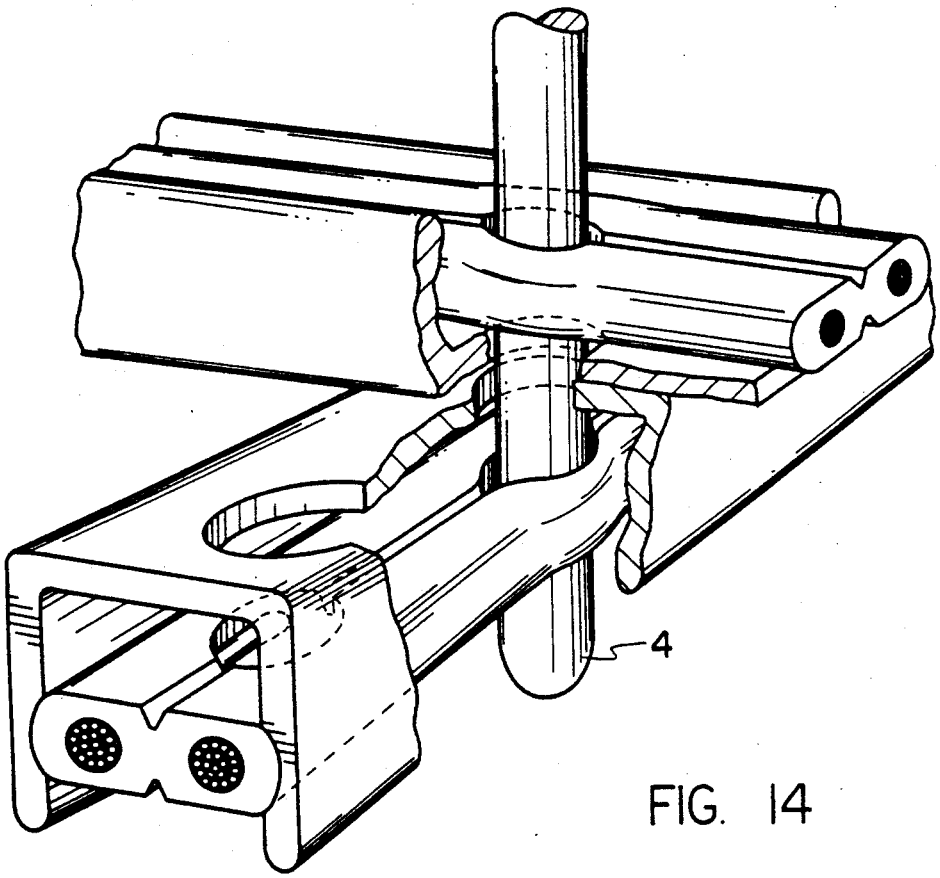
FIG. 14 shows in enlarged perspective view, and partly in section, a crossing point of the cross bar distributor, or of the current bar selector of FIG. 9 and FIG. 10, respectively.

The current bar arrangement constructed according to the invention can provide good service for still other technical applications. This is explained in the example of a cross-bar distributor, as shown in FIG. 12. The individual bars are arranged in two planes one above the other, horizontal and vertical, of the cross-bar distributor shown. The individual bars are formed of current bar arrangements constructed according to the invention, but with one pole used in each case. As shown in FIG. 14, connections can be produced between an upper and a lower current bar by passing through a central one-pole plug pin 4 of round cross-section at the intersection points in matrix form in each case. With this, the inlets A, B, and C can be connected, as desired, with the outlets a to d. The cable channels are preferably arranged with their bottom strips lying one above the other. Naturally, for such a use, cable channels with holes provided in their bottom strips must be used. Also, the distance between the holes in the bottom strip must correspond to the distance between the holes in the perforated cables.

Figure 13:
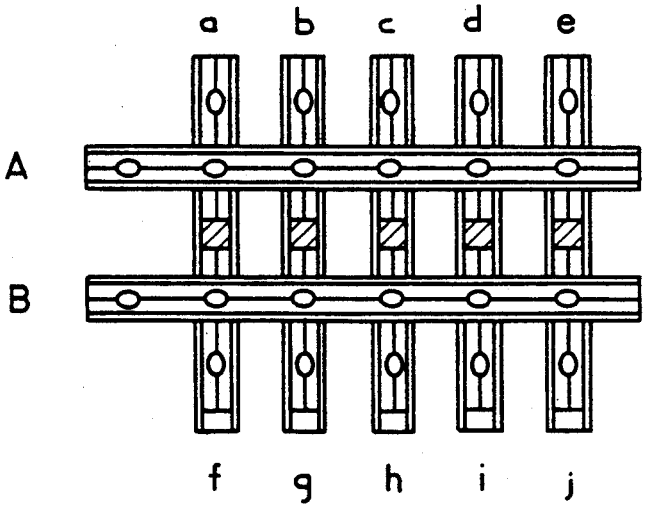
FIG. 13 shows in top view a current bar selector obtained by several current bar arrangement constructed according to the invention.

FIG. 13 shows a current bar selector with five vertical current bar arrangements, again with only one pole used and two horizontal current bar arrangements lying above these. In the five lower current bar arrangements, the perforated cables are interrupted in the middle. The upper halves of the interrupted perforated cables lead to outlets a to e, and the lower halves to outlets f to j. With this current bar selector, the inlet A can be connected, as desired, with one of outlets a to e, and entrance B with one of the outlets f to j. The connection is made as in the cross-bar distributor explained before, as shown in FIG. 14.

The current bar arrangement constructed according to the invention may, as explained, be used for low voltage of only 42 V, for example, but also for higher voltages of 110 V or 220 V for example. Thus, they may be used in electric laboratories, in testing rooms, in solar units, in lighting systems, in the connection of lighting bodies, and in any electric equipment in which voltage corresponding to that of the current bar arrangement is provided in each case.

Having described specific preferred embodiments of the invention, the following is claimed:

1. Current bar arrangement comprising a flat, two-strand, flexible cable (2) including a rubber-like insulation (2.3) with a plurality of holes (2.4) stamped into the insulation at a distance from each other between the two strands (2.1, 2.1), the two strands being laid open for a short distance in width in each case, and a cable channel (1) being form-stable in the lengthwise direction and having a substantially U-shaped profile, the cable channel (1) including a base strip (1.3) and two leg strips (1.1, 1.2) for receiving and holding the cable between the two leg strips in the parallel direction of the base strip.

2. Current bar arrangement according to claim 1 with the distinction that the base strip of the cable channel is provided with a plurality of holes (1.4) distanced from each other.

3. Current bar arrangement according to claim 2, with the distinction that the holes in the base strip are arranged at the same distance from each other as the holes in the cable.

4. Current bar arrangement according to claim 1, with the distinction that the base strip of the cable channel is provided on the outside with a glue adhesion layer, preferably covered with a protective foil which can be rubbed off.

5. Current bar arrangement according to claim 1, with the distinction that each leg strip of the cable channel is provided on the outside with a groove or a spring strip.

6. Current bar arrangement comprising a flat, two-strand, flexible cable (2) including a rubber-like insulation (2.3) with a plurality of holes (2.4) stamped into the insulation at a distance from each other between the two strands (2.1, 2.1), the two strands being laid open for a short distance in width in each case, and a cable channel (1) being form-stable in the lengthwise direction and having a substantially U-shaped profile, the cable channel (1) including a base strip (1.3) and two leg strips (1.1, 1.2) for receiving and holding the cable between the two leg strips in the parallel direction of the base strip, the two leg strips of the cable channel being designed to spring outward.

7. Current bar arrangement according to claim 6, with the distinction that the spring characteristic of the two leg strips of the cable channel are so designed that the cable, over its whole length, can be pressed into the cable channel from outside with the springing apart of the leg strips of the cable channel and held in the cable channel with the springing back of the leg strips.

8. Current bar arrangement comprising a flat, two-strand, flexible cable (2) including a rubber-like insulation (2.3) with a plurality of holes (2.4) stamped into the insulation at a distance from each other between the two strands (2.1, 2.1), the two strands being laid open for a short distance in width in each case, and a cable channel (1) being form-stable in the lengthwise direction and having a substantially U-shaped profile, the cable channel (1) including a base strip (1.3) and two leg strips (1.1, 1.2) for receiving and holding the cable between the two leg strips in the parallel direction of the base strip, the cable being arranged in the cable channel at a distance from its base strip.

9. Current bar arrangement according to claim 8, with the distinction that the distance between the cable arranged in the cable channel and the base strip is equal to the thickness of the cable.

* * * * *